US010065301B2

(12) United States Patent
Jagdale et al.

(10) Patent No.: US 10,065,301 B2
(45) Date of Patent: Sep. 4, 2018

(54) LOWER BUFFER AND BUSHING PROTECTOR

(71) Applicant: Caterpillar Inc., Peoria, IL (US)

(72) Inventors: Rakesh Jagdale, Waco, TX (US); Vaino Esko Juvonen, Espoo (FI)

(73) Assignee: Caterpillar Inc., Deerfield, IL (US)

( * ) Notice: Subject to any disclaimer, the term of this patent is extended or adjusted under 35 U.S.C. 154(b) by 659 days.

(21) Appl. No.: 14/615,061

(22) Filed: Feb. 5, 2015

(65) Prior Publication Data

US 2016/0229044 A1 Aug. 11, 2016

(51) Int. Cl.

| | |
|---|---|
| ***B25D 17/08*** | (2006.01) |
| ***B25D 17/00*** | (2006.01) |
| ***E02F 3/96*** | (2006.01) |
| ***B25D 9/04*** | (2006.01) |

(52) U.S. Cl.

CPC ..... *B25D 17/08* (2013.01); *B25D 9/04* (2013.01); *B25D 17/00* (2013.01); *E02F 3/966* (2013.01); *B25D 2250/105* (2013.01); *B25D 2250/121* (2013.01); *B25D 2250/365* (2013.01)

(58) Field of Classification Search

CPC .. B25D 2250/365; B25D 17/00; B25D 17/08; F16J 15/3224; F16J 15/3268; E21B 19/155; E21B 7/02; E21B 7/025; E21B 7/027; E21B 15/00; E21B 7/00; E21D 20/00

USPC ..... 173/184–189, 24–28, 90, 220

See application file for complete search history.

(56) References Cited

U.S. PATENT DOCUMENTS 2,236,121 A * 3/1941 Tuttle ..... B25D 17/08 279/19.7
2,236,122 A * 3/1941 Tuttle ..... B25D 17/08 279/19.7
4,231,580 A * 11/1980 Emonet ..... B25D 17/082 279/19
5,125,145 A * 6/1992 Williams ..... B25B 27/026 29/252
5,873,579 A * 2/1999 Prokop ..... B25D 17/00 175/296

(Continued)

FOREIGN PATENT DOCUMENTS

EP 1052070 11/2000
EP 1052070 A2 * 11/2000 ..... B23Q 3/12

(Continued)

*Primary Examiner* — Hemant M Desai
*Assistant Examiner* — Valentin Neacsu
(74) *Attorney, Agent, or Firm* — Miller, Matthias & Hull

(57) ABSTRACT

A protection assembly for a work implement includes an outer shield member and an inner shield member. The outer shield member is spaced from a housing of the work implement in a longitudinal direction and defines a channel. The channel extends to an exterior of the protection assembly. The inner shield member defines an opening and is slideably disposed in the channel. The inner shield member is free to slide in a transverse direction that is substantially perpendicular to the longitudinal direction. Movement of the inner shield member in the longitudinal direction is restricted by the housing of the work implement and the outer shield member. Movement of the inner shield member in the transverse direction is restricted by a work tool that is locked within and projects out of the housing and through the opening in the inner shield.

15 Claims, 9 Drawing Sheets

(56) References Cited

U.S. PATENT DOCUMENTS

| | | | | |
|---|---|---|---|---|
| 6,328,116 | B1 | 12/2001 | Hurskainen et al. | |
| 6,510,904 | B1 * | 1/2003 | Tyrrell | B25D 17/08 173/128 |
| 6,648,079 | B2 * | 11/2003 | Deimel | B25D 17/22 173/114 |
| 8,500,207 | B2 * | 8/2013 | Nickels | E02F 3/966 173/185 |
| 2003/0136586 | A1 * | 7/2003 | Schneider | B25D 17/00 175/135 |
| 2006/0254786 | A1 * | 11/2006 | Murakami | B25B 21/02 173/109 |
| 2007/0068707 | A1 * | 3/2007 | Henriksson | B25D 9/125 175/417 |
| 2008/0008523 | A1 * | 1/2008 | Cadet | B25D 17/08 403/319 |
| 2012/0037389 | A1 * | 2/2012 | Jagdale | B25D 17/20 173/90 |
| 2012/0145422 | A1 * | 6/2012 | Nickels | E02F 3/966 173/46 |
| 2012/0145424 | A1 * | 6/2012 | Nickels | E02F 3/966 173/90 |
| 2015/0251304 | A1 * | 9/2015 | Escolle | B25D 9/12 173/206 |
| 2016/0123472 | A1 * | 5/2016 | Kahra | B25D 17/00 299/100 |

FOREIGN PATENT DOCUMENTS

| | | | | |
|---|---|---|---|---|
| WO | 2010064873 | | 6/2010 | |
| WO | WO 2010064873 | A2 * | 6/2010 | B25D 17/11 |
| WO | WO 2013048753 | A2 * | 4/2013 | E02D 7/18 |

* cited by examiner

LOWER BUFFER AND BUSHING PROTECTOR

TECHNICAL FIELD

This disclosure relates generally to an impact hammer, and more particularly, to a system and apparatus for protecting components of an impact hammer used in mining and construction machinery.

BACKGROUND

Impact hammer tools may be used to penetrate and break up hardened materials such as rock, concrete, asphalt, or the like. During operation of an impact hammer, dust, grains, dirt, or larger particles of several millimeters in diameter are created. These particles disperse in various directions including toward the impact hammer. An impact hammer tool having a tool bit that protrudes from a housing element is particularly susceptible to these small and large particles. As the tool bit extends and retracts, the particles may be pulled back into the housing where they may get stuck and/or cause increased wear and premature breakdown of the internal components of the impact hammer.

Current systems for reducing wear of tool components include the use of protective devices. U.S. Pat. No. 5,873,579 describes a fluid operated percussion tool having a protective device. The protective device is intended to reduce wear while operating under heavy duty conditions, and includes multiple parts supported within a housing element. During operation, a tool bit slideably moves within the housing and protrudes through the protective device. As small particles are formed and disperse, a plate-shaped transverse slide protects the internal components of the percussion tool. Although this conventional system may provide an approach to protect a tool from small particles, it includes multiple parts, can be expensive to replace, provides minimal protection against larger particles, and can require maintenance to ensure the protective device is properly aligned.

To overcome these issues, elastic sealing elements have been used for protecting internal components. The elastic seal elements are pressed against the tool bit to seek to prevent penetration of particles. However, such protective devices are easily damaged during heavy duty use and are further exposed to significant wear due to continuous reciprocating motions of the tool bit.

Thus, an improved system for protecting components of an impact hammer is desired to reduce wear and increase the life of the impact hammer.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

An aspect of the present disclosure provides a protection assembly for a work implement that includes a housing. The protection assembly includes a first outer shield member and an inner shield member. The first outer shield member is spaced apart from the housing by a first distance along a longitudinal direction, whereby the housing and the first outer shield member define a channel therebetween. The channel extends in a transverse direction that is substantially perpendicular to the longitudinal direction, such that the channel extends to an exterior of the protection assembly. The first outer shield member has an outer concave edge that extends in a circumferential direction about a first axis that extends along the longitudinal direction. The inner shield member is slideably disposed in the channel. The inner shield member is free to slide along the channel in the transverse direction. The inner shield member has an internal edge and an external edge. The internal edge extends in the circumferential direction about a second axis that extends along the longitudinal direction. The internal edge defines an opening through the inner shield member. The internal edge of the inner shield member is disposed closer to the first axis than the outer concave edge of the first outer shield member along a radial direction. The radial direction is substantially perpendicular to the longitudinal direction.

Another aspect of the present disclosure provides an impact hammer system. The impact hammer system includes a housing, a first outer shield member, an inner shield member, and a work tool. The first outer shield member is spaced apart from the housing by a first distance along a longitudinal direction, whereby the housing and the first outer shield member define a channel therebetween. The channel extends in a transverse direction that is substantially perpendicular to the longitudinal direction, such that the channel extends to an exterior of the impact hammer system. The first outer shield member has an outer concave edge that extends in a circumferential direction about a first axis that extends along the longitudinal direction. The inner shield member is slideably disposed in the channel and free to slide along the channel in the transverse direction. The inner shield member has an internal edge and an external edge. The internal edge extends in the circumferential direction about a second axis that extends along the longitudinal direction and defines an opening through the inner shield member. The internal edge is disposed closer to the first axis than the outer concave edge of the first outer shield member along a radial direction. The radial direction is substantially perpendicular to the longitudinal direction. The work tool projects from the housing through the channel and the opening of the inner shield member in the longitudinal direction.

Another aspect of the present disclosure provides a method for assembling a protection assembly for an impact hammer system. The impact hammer system includes a housing, a first outer shield member, an inner shield member, and a work tool. The first outer shield member is spaced apart from the housing by a first distance along a longitudinal direction. The housing and the first outer shield member define a channel therebetween, which extends in a transverse direction that is substantially perpendicular to the longitudinal direction. The first outer shield member has an outer concave edge that extends in a circumferential direction about a first axis that extends along the longitudinal direction. The inner shield member has an internal edge and an external edge. The internal edge extends in the circumferential direction about a second axis that extends along the longitudinal direction, and defines an opening through the inner shield member. The internal edge of the inner shield member is disposed closer to the first axis than the outer concave edge of the first outer shield member along a radial direction. The radial direction is perpendicular to the longitudinal direction. The method includes connecting the first outer shield member to the housing, sliding an inner shield member along the channel in the transverse direction, and connecting a work tool to the housing. The work tool projects from the housing through the channel and the opening of the inner shield member in the longitudinal direction.

DETAILED DESCRIPTION OF ILLUSTRATIVE EMBODIMENTS

The disclosure relates generally to protective devices for a work implement, such as an impact hammer. The protective device includes an outer protective member and an inner protective member configured to minimize the impact of hardened materials against a bottom end of a work implement during a breaking operation.

Figure 1:
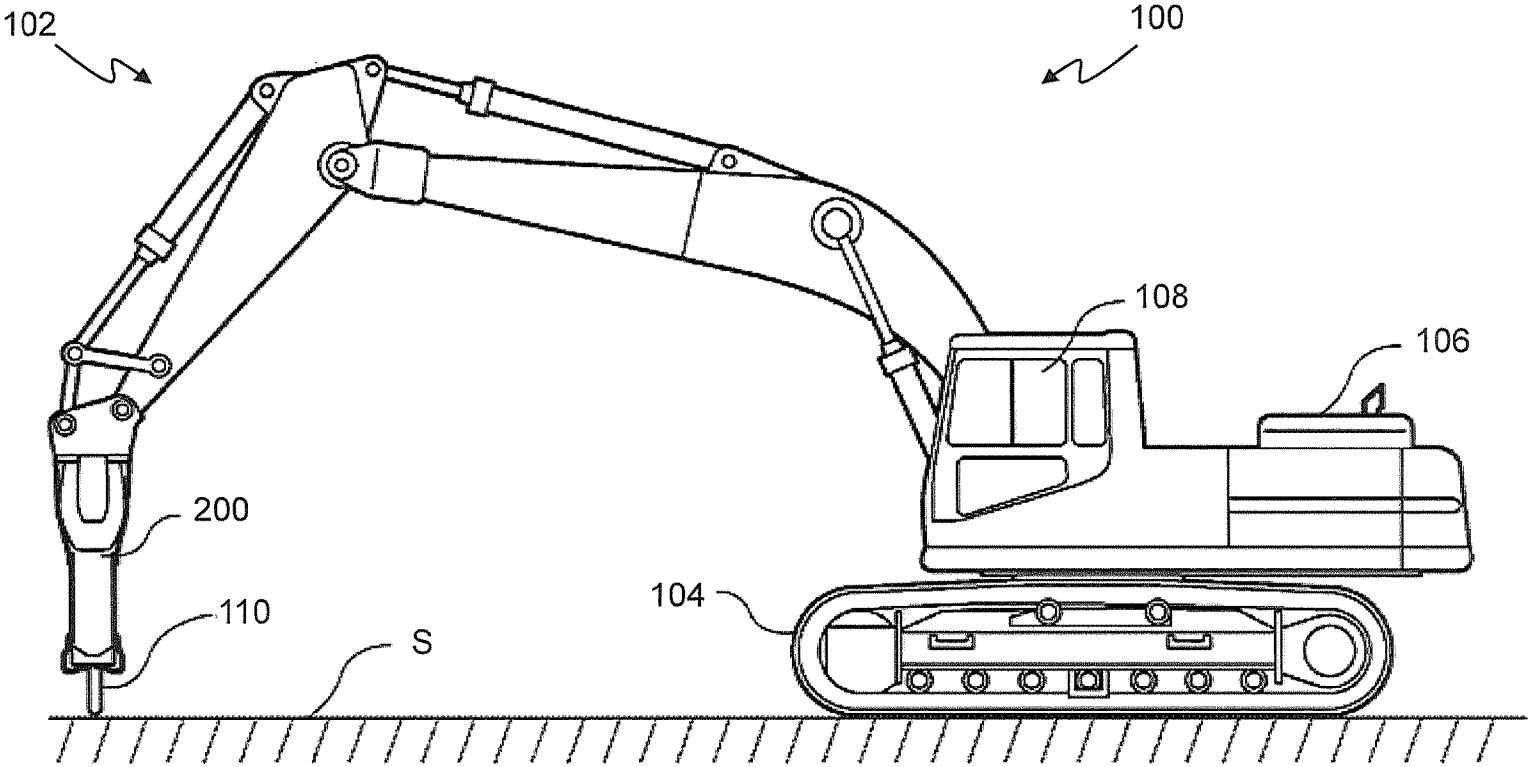
FIG. 1 illustrates a machine having an impact hammer, according to an aspect of the disclosure.

FIG. 1 illustrates a machine 100 having an impact hammer system 200, according to an aspect of this disclosure. Machine 100 may embody a fixed or mobile machine that performs some type of operation associated with an industry such as mining, construction, farming, transportation, or any other industry known in the art. For example, machine 100 may be an earth moving machine such as a backhoe, an excavator, a dozer, a loader, a motor grader, or any other earth moving machine. Machine 100 may include an implement system 102 configured to move the impact hammer system 200, a drive system 104 for propelling machine 100, a power source 106 that provides power to implement system 102 and drive system 104, and an operator station 108 for operator control of implement system 102 and drive system 104.

Power source 106 may embody an engine such as, for example, a compression ignition engine, a spark ignition engine, or any other type of combustion engine known in the art. It is contemplated that power source 106 may alternatively embody a non-combustion source of power such as a fuel cell, a power storage device, or another power source known in the art. Power source 106 may produce a mechanical or electrical power output that may then be converted to hydraulic power for moving implement system 102.

Implement system 102 may include a linkage structure acted on by fluid actuators to move the impact hammer system 200. The linkage structure of implement system 102 may include three or more degrees of freedom. The implement system 102 may carry the impact hammer system 200, which has a work tool 110 for impacting an object or ground surface S. The work tool 110 has an outer surface 111 (see FIG. 3A) that may define any number of cross sections for work tools that are recognized in the art.

Figure 2:
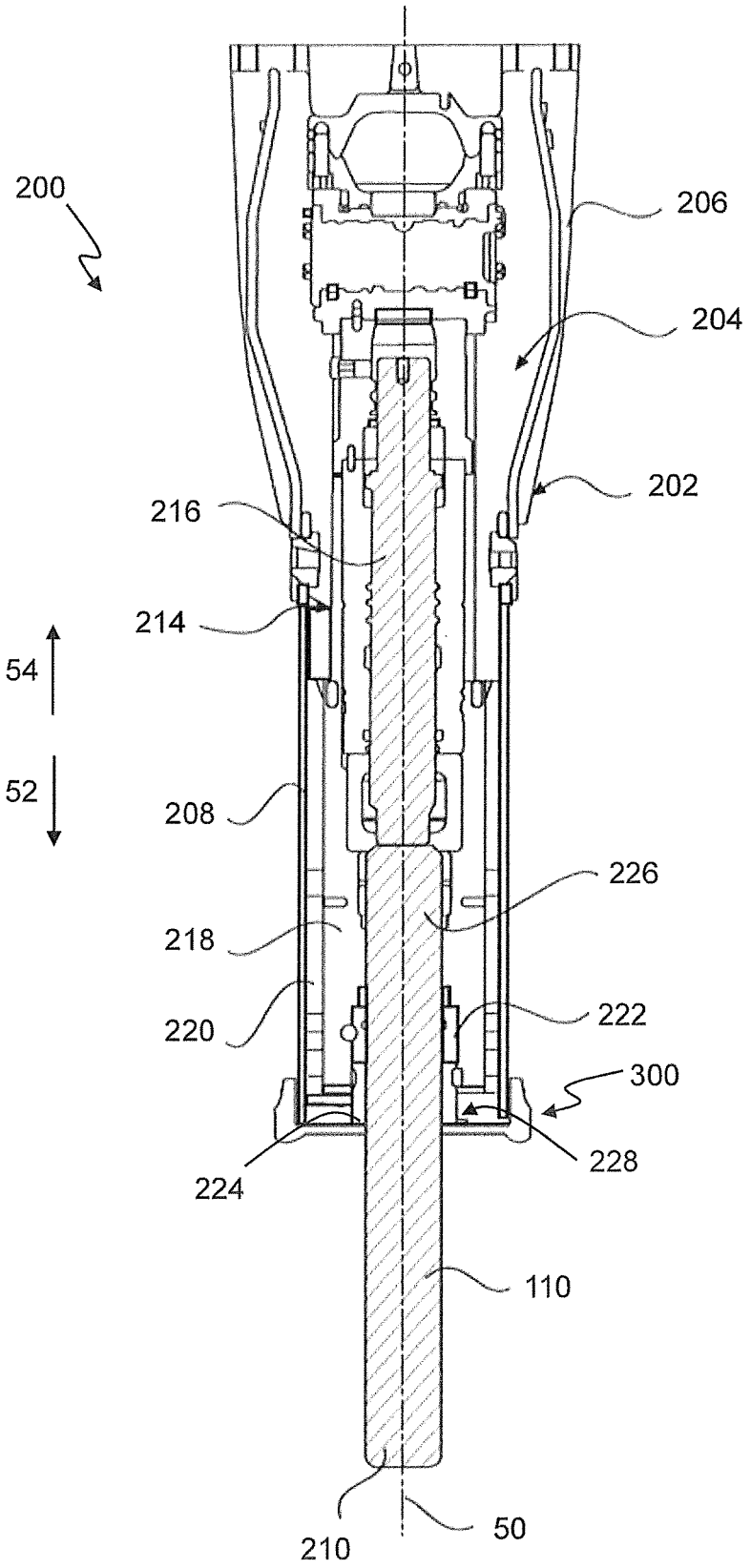
FIG. 2 illustrates a cross-sectional side view of an impact hammer, according to an aspect of this disclosure.

FIG. 2 shows a cross-sectional view of the impact hammer system 200 of FIG. 1. It will be appreciated that an impact hammer system 200 may include any type of impact hammer known or used in the art, such as a pneumatic impact hammer, a hydraulic impact hammer, or the like. The impact hammer system 200 extends along a central longitudinal axis 50 and includes a housing 202 defining a chamber 204. The housing 202 may include an upper housing member 206 and a lower housing member 208 positioned below the upper housing member 206 along the central axis 50. The terms "above" and "below," as used herein, describe the positions of certain components relative to one another and are thus approximations. The terms "above", "upper", or "uppermost" mean a position that is closer to the upper housing member 206 along the central axis 50, and the terms "below", "bottom", or "bottommost" mean a position closer to a tip 210 of the work tool 110 along the central axis 50.

The upper and lower housing members 206, 208 may be welded or otherwise coupled together. The housing members 206, 208 define upper and lower chambers (not labeled), respectively, and together make up the chamber 204. A power cell 214 is disposed inside the housing chamber 204 and includes several internal components of the impact hammer system 200. As shown in FIG. 2, the power cell 214 provides an impact assembly that includes a piston 216. The piston 216 is operatively housed in the chamber 206 such that the piston 216 can translate along the central longitudinal axis 50 in the general direction of arrows 52 and 54. In particular, during a work stroke, the piston 216 moves in the general direction of arrow 52, while during a return stroke the piston 216 moves in the general direction of arrow 54.

A portion of the power cell 214 includes the work tool 110 and structure for guiding the work tool 110 during operation. Accordingly, the power cell 214 includes a front head 218 inserted into the lower housing member 208 with wear plates 220 interposed between the front head 218 and the housing 202. A lower bushing 222 may be inserted into a bottom end of the front head 218 so that a bottommost end 224 of the lower bushing 222 is positioned adjacent the bottom end of the housing 202.

According to an aspect of this disclosure, a hydraulic circuit (not shown) provides pressurized fluid to drive the piston 216 toward the work tool 110 during the work stroke and to return the piston 216 during the return stroke. It should be appreciated that any suitable hydraulic circuit may be used to provide a pressurized fluid to the piston 216.

In operation, near the end of the work stroke, the piston 216 strikes the uppermost section 226 of the work tool 110. The bottommost portion of the work tool 110 may include the tip 210 positioned to engage an object or ground surface S. The impact of the piston 216 on the uppermost section 226 drives the tip 210 into the object or ground surface S, thereby creating pieces of broken material as well as dust, grit, and other debris. The broken material may range in size from a few millimeters in diameter to larger pieces that may have diameters of several centimeters. The impact hammer system 200 may include a composite seal 228 having an exterior cover 302 (see FIG. 3A) and an interior seal 304 (see FIG. 3A). The composite seal 228 may prevent dust and other broken material from migrating along the work tool 110 and into the interior components of the power cell 214.

The impact hammer system 200 may also include a protection assembly 300 (see FIG. 3A) for preventing broken material having a larger diameter from impacting the internal components of the hammer 200. The protection assembly 300 may be coupled by any suitable manner, such as welding, fasteners, or other suitable means, to the outer surface 306 of the bottommost end of the housing 202.

Figure 3A:
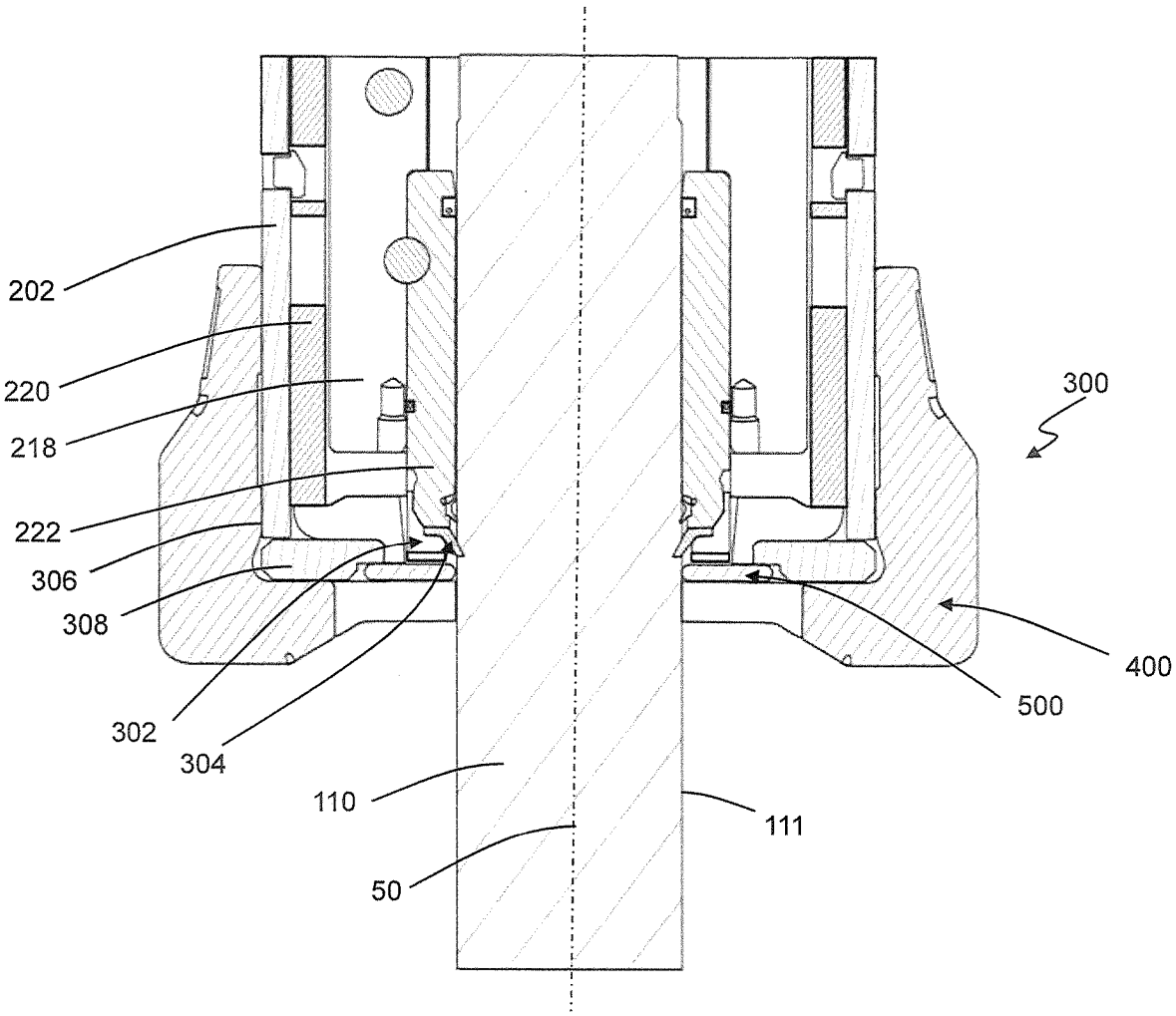
FIG. 3A is a cross sectional side view of a protection assembly attached to an impact hammer, according to an aspect of the disclosure.

FIG. 3A illustrates a side view of a cross section of the bottom end of an impact hammer system 200 with the protection assembly 300 attached. The protection assembly 300 may include an outer shield member 400 and an inner shield member 500. The outer shield member 400 may include a first outer shield member 402 and a second outer shield member 404 (see FIG. 3B). It will be appreciated that the outer shield member 400 may also include only a single member. The outer shield member 400 may be formed from a variety of materials. Since the outer shield member 400 may be exposed to abrasive wear from contact with hard objects, the outer shield member 400 may be formed from a suitable wear-resistant metal, ceramic, composite, or other material.

The first and second outer shield members 402, 404 may be attached to the housing 202 and used to engage and move hard objects while adequately protecting the bottom end of the housing 202 and the tool 110 from damage during operation. In the depicted embodiment, the first and second outer shield members 402, 404 may be substantially identical, however, it will be appreciated that in other embodiments the outer shield members 402, 404 may be shaped differently. The second outer shield member 404 may include any of the features or attributes described above for the first outer shield member 402.

Figure 3B:
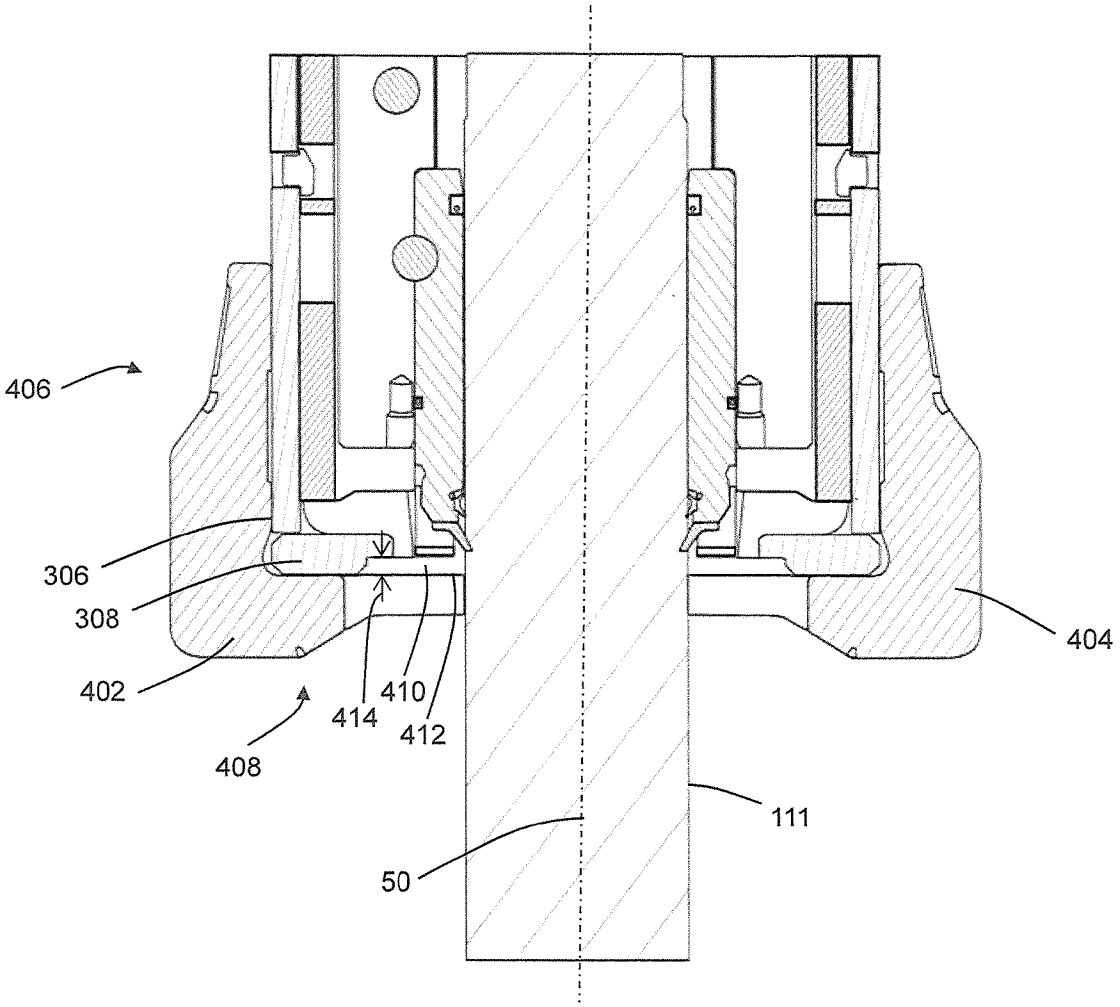
FIG. 3B is a cross sectional side view of another aspect of the protection assembly attached to an impact hammer, according to an aspect of this disclosure.

FIG. 3B illustrates a side view of a cross section of the bottom end of the impact hammer system 200. As shown in FIG. 3B, the outer shield member 400 is attached to the housing 202 and the inner shield member 500 is removed. The first outer shield member 402 includes a first portion 406 and a second portion 408. The first portion 406 may be configured in a variety of ways, such that the first portion 406 protects the sidewall of the bottommost end of the lower housing member 208 from damage by hard objects. The first portion 406 may be coupled to the outer surface 306 of the bottommost end of the lower housing member 208. The second portion 408 may be configured to protect the bottom of the lower housing member 208 and the end plate 308 from damage by hard objects. The second portion 408 extends over a portion of the bottom most end of the housing 202, such that the work tool 110 may project from the housing 202 along the central longitudinal axis 50 through the outer shield member 400.

The second portion 408 of the first outer shield member 402 is spaced below the housing 202 at a distance 414, such that a channel 410 is defined therebetween. The channel 410 may extend in a transverse direction 72 along axis 70 (see FIG. 5), whereby axis 70 may be substantially perpendicular to the longitudinal axis 50. The channel 410 may extend through the protection assembly 300, defining a transverse opening 412 on either side of the impact hammer system 200. It will be appreciated that the channel 410 may only extend partially through the impact hammer system 200, such that there is only one opening 412 on a side of the hammer 200. Further, in another aspect, the channel 410 may include obstructions either within the channel or at the openings 412. The obstructions may include gates, flaps, doors, or the like, to inhibit flow of objects through the channel 410. In still further aspects, the channel may open to multiple exterior surfaces of the protection assembly 300.

Figure 4:
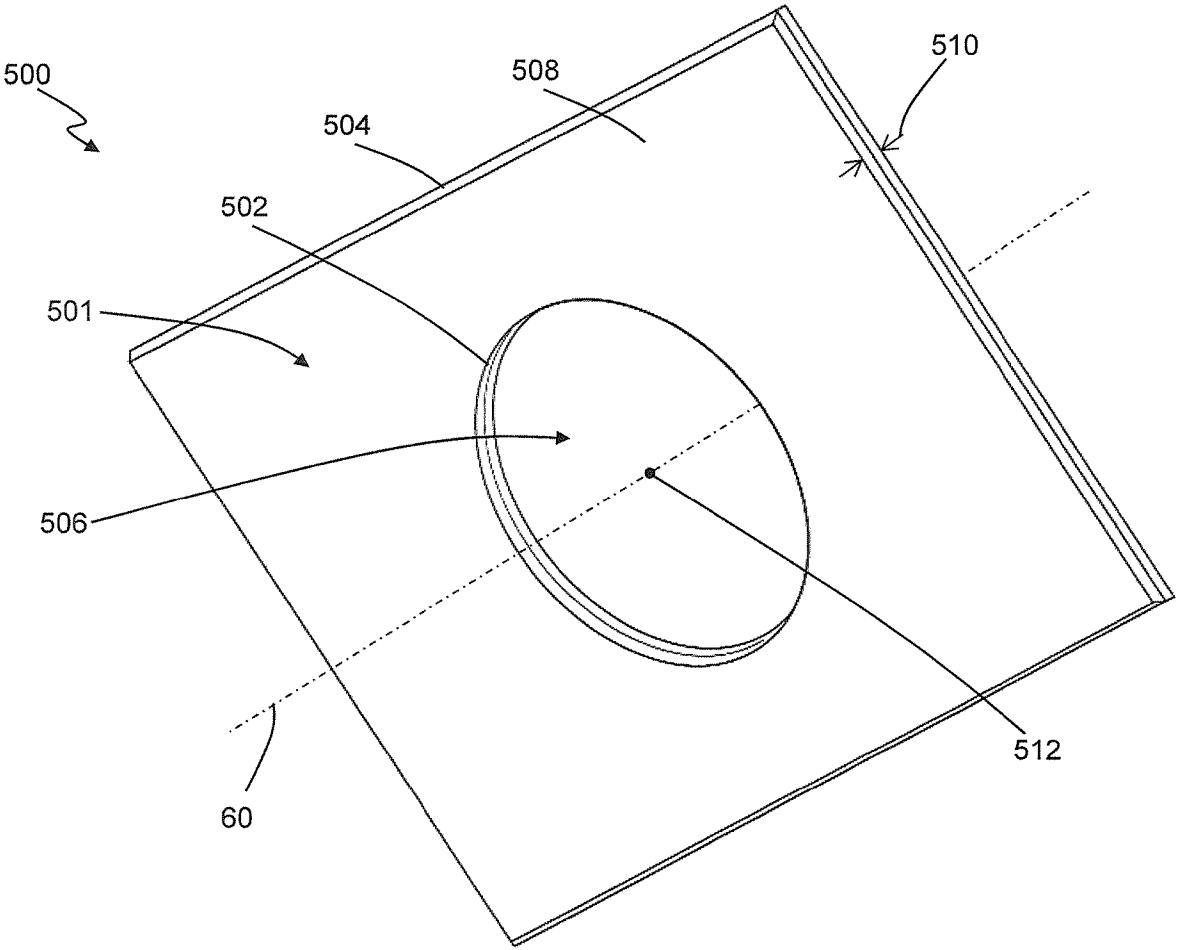
FIG. 4 is a perspective view of an inner shield member, according to an aspect of this disclosure.

FIG. 4 illustrates a perspective view of the inner shield member 500. The inner shield member 500 may have an inner shield body 501, an internal edge 502, and an external edge 504. The internal edge 502 and the external edge 504 extend circumferentially about an axis 60. The internal edge 502 defines an internal opening 506, or hole, that extends through the inner shield member 500 from a first surface 508 to an opposing back surface (not labeled) along axis 60. It should be appreciated that the internal opening 506 may have a variety of shapes, for example, but not limited to, circular, rectangular, or ellipsoidal, and may be configured to allow a work tool 110 to slide therethrough. In a preferred embodiment, the internal opening 506 has a shape and size that is substantially similar to the shape and size of a cross section of the outer surface 111 of the work tool 110, which may result in a slip fit tolerance therebetween.

The internal opening 506 may be positioned about a geometric center 512 of the internal shield member 500. In alternative aspects, the internal opening 506 may be positioned offset from the geometric center 512. The internal opening 506 may be offset from the center 512 to provide easier access to the inner shield member 500, to protect specific components of the bottom of the hammer system 200, for manufacturing purposes, or for other reasons deemed beneficial for implementation of the protection assembly 300.

The inner shield member 500 may have a thickness 510 that extends from the first surface 508 to the opposing back surface. The thickness 510 may be uniform throughout the body 501, such that the distance from the first surface 508 to the opposing back surface at any point on the inner shield body 501 is substantially the same. The inner shield member may be a substantially flat plate that is rectangular in shape. However, in alternative aspects, the thickness 510 of the inner shield member 500 may vary throughout the inner shield body 501. One such aspect may include an increased thickness in areas of the inner shield body 501 that may provide enhanced protection to specific components of the impact hammer 200. In another aspect, the inner shield body 501 may have an increased thickness around the internal edge 502, which may help mitigate the effects of wear due to the work tool 110 during operation.

According to an aspect of this disclosure, the inner shield member 500 may be positioned within the impact hammer system 200 so that axis 60 aligns with the central longitudinal axis 50. The inner shield member 500 may be slideably disposed within the channel 410. The inner shield member may enter the channel 410 through either transverse opening 412 and may be free to slide along the channel 410 in the transverse direction 72. The inner shield member 500 may also be positioned with the channel 410 prior to the outer shield member 400 being coupled to the housing 202. Further, if there is a single outer shield member 400 attached to the housing 202, such as the first outer shield member 402, the inner shield member 500 may be positioned in the channel 410 from various angles that are perpendicular to the longitudinal axis 50. In an aspect of this disclosure, the thickness 510 of the inner shield member 500 may be substantially the same as the distance 414 between the outer shield member 400 and the housing 202.

Figure 5:
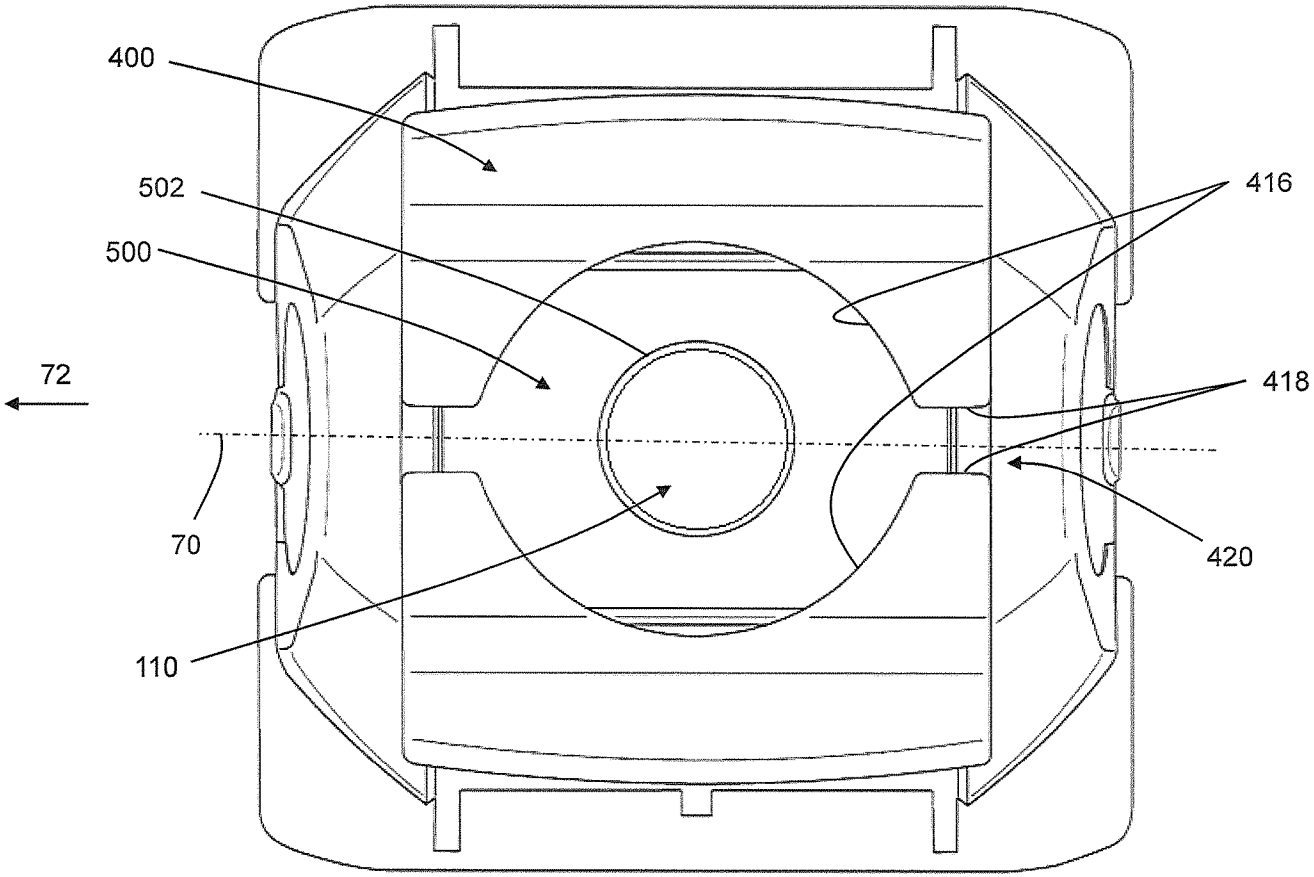
FIG. 5 illustrates a bottom view of an impact hammer having an inner shield disposed within, according to an aspect of this disclosure.

FIG. 5 illustrates a bottom view of the impact hammer system 200 having the inner shield member 500 disposed within the channel 410. The outer shield member 400 has an outer concave edge 416 that extends in a circumferential direction about the central longitudinal axis 50. The outer concave edge 416 may define an outer opening (not labeled to promote clarity of other features) that extends at least partially through the outer shield member 400. As illustrated, the outer concave edge 416 may not be continuous around axis 50 and may include an access region 420 defined by external edges 418. The access region 420 may provide a simplified means for accessing the inner shield member 500 within the channel 410. However, in another aspect, the concave edge 416 may be continuous and extend entirely around axis 50. In either aspect, the inner shield member 500 may be accessed through one of the transverse openings 412. The inner shield member 500 may also be accessed upon removal of the outer shield member 400 from the housing 202.

The internal edge 502 of the inner shield member 500 may be disposed closer to the central longitudinal axis 50 than the outer concave edge 416 of the first outer shield member 402 along a radial direction, where the radial direction is substantially perpendicular to the longitudinal axis 50. This may allow the outer shield member 400 to act as a support assembly by supporting the inner shield member 500 within the channel 410 from below. The surface 508 of the inner shield member 500 may be positioned on top of the second portion 408 of the outer shield member 400. The outer shield member 400 and the housing 202 may restrict the movement of the inner shield member 500 along the longitudinal axis 50.

Figure 6A:
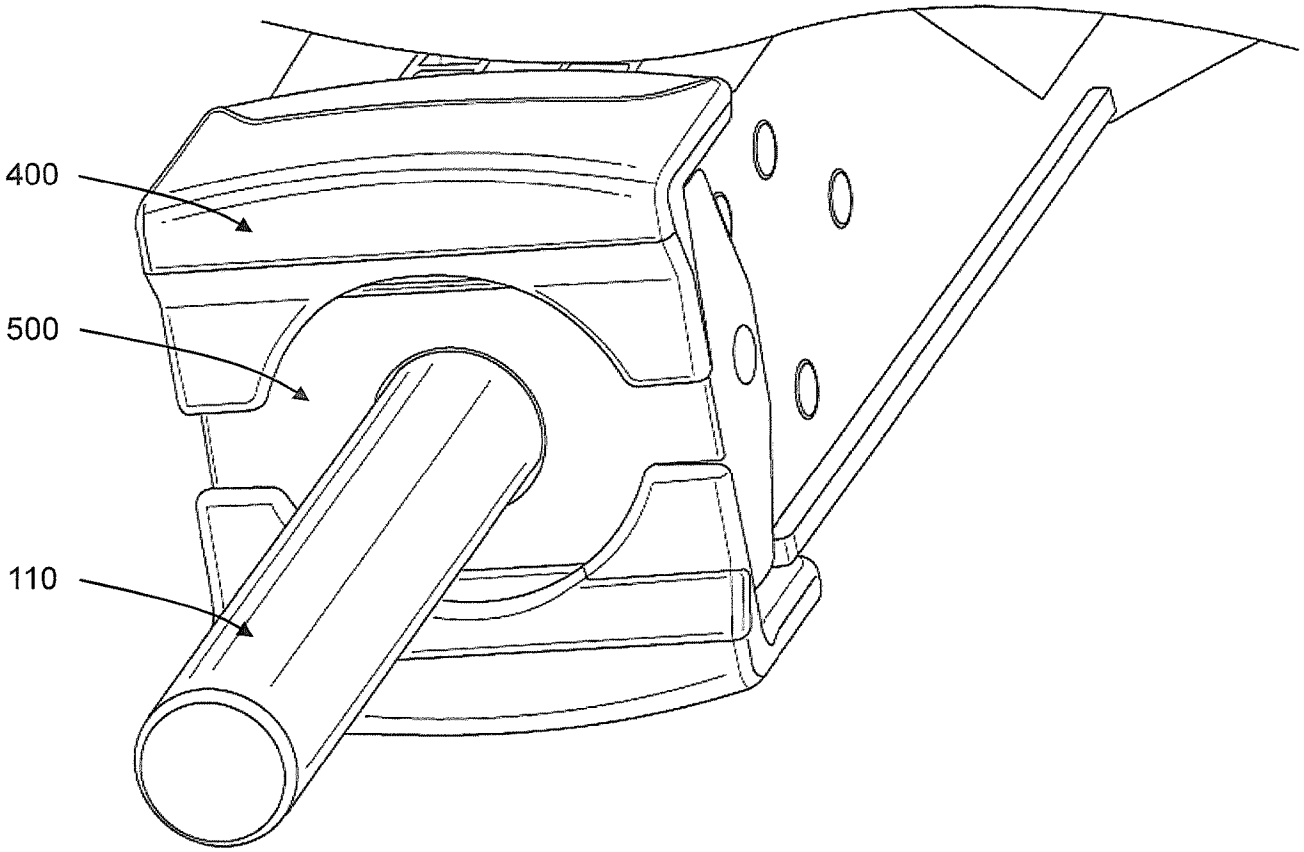
FIG. 6A illustrates an assembled view of an impact hammer, according to an aspect of this disclosure.
Figure 6B:
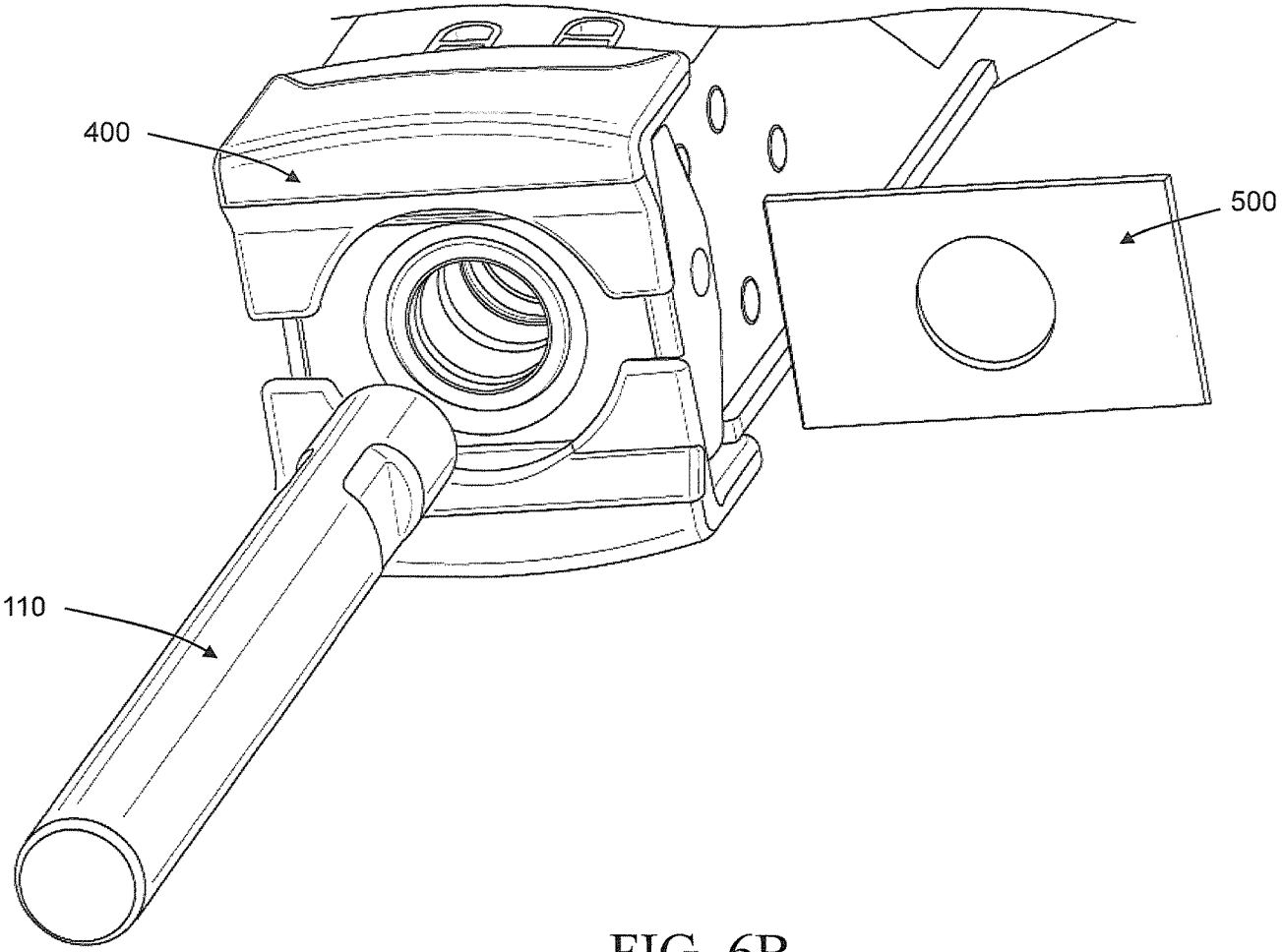
FIG. 6B illustrates an exploded view of an impact hammer, according to an aspect of this disclosure.

FIGS. 6A and 6B illustrate a perspective view of the impact hammer system 200 in an assembled view and an exploded view, respectively. The inner shield member 500 may be held in place by the work tool 110. The work tool 110 projects from the housing 202 through the internal opening 506 of the inner shield member 500. The outer surface 111 of the work tool 110 may be in contact with the internal edge 502 of the inner shield member 500 restricting the motion of the inner shield member 500 along the transverse axis 70. Therefore, in an aspect of this disclosure, the work took 110 may be removed from the housing 202 in order to remove the inner shield member 500 from the impact hammer 200.

Figure 7:
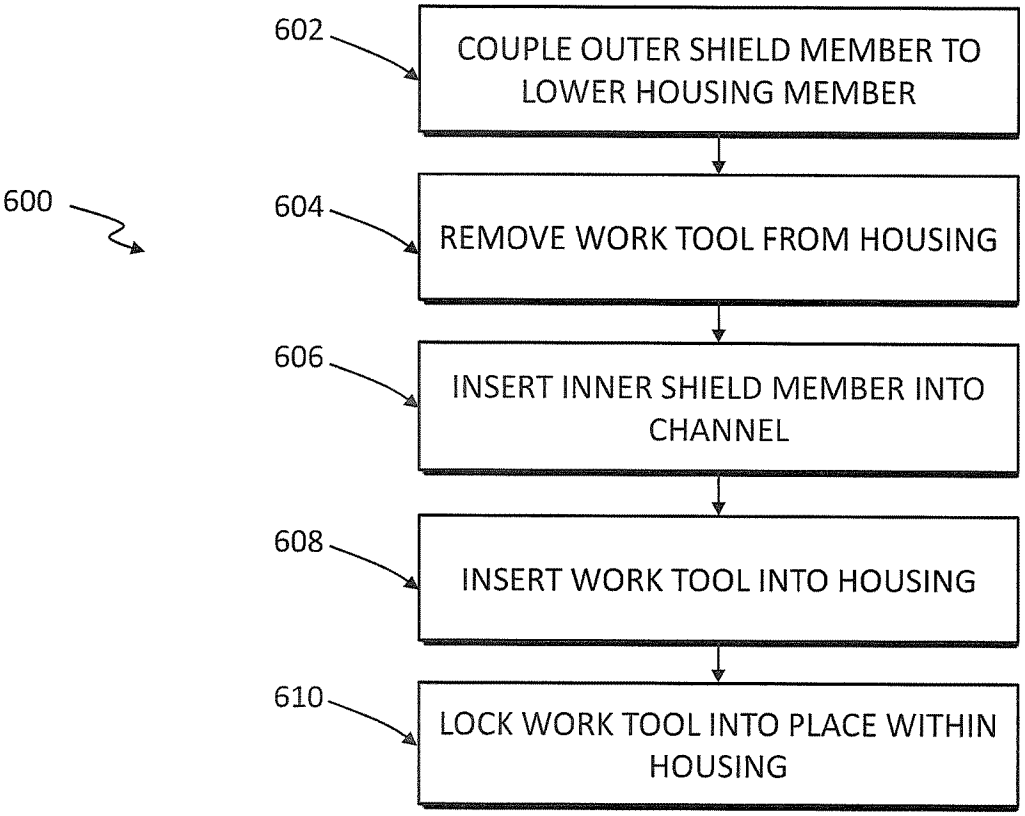
FIG. 7 is a flowchart of a method for incorporating a protection assembly into an impact hammer system.

FIG. 7 illustrates a flowchart of a method 600 for incorporating the protection assembly 300 into the impact hammer system 200. A first step (602) may involve coupling the outer shield member 400 to the outer surface 306 of the bottommost end of the lower housing member 208. The work tool 110 may be removed (604) from the housing 202, thereby allowing the inner shield member 500 to be inserted (606) into the channel 410 through the opening 412. The inner shield member 500 may slide along axis 70 in the transverse direction 72 until axis 60 of the inner shield member 500 aligns with central longitudinal axis 50 of the impact hammer system 200. The work tool 110 may be inserted (608) into the housing 202 by sliding along the central axis 50 through the outer opening of the outer shield member 400 and the internal opening 506 of the inner shield member 500. The work tool 110 may be locked into place (610) within the housing 202. The inner shield member 500 may be locked into place, whereby movement along the longitudinal axis 50 and the transverse axis 70 is restricted, and a breaking operation may commence.

To replace an inner shield member 500, the work tool 110 may be unlocked from the housing 202, and removed along the longitudinal axis 50 from the housing 202, the internal opening 506 of the inner shield member 500, and the outer opening of the outer shield member 400. The inner shield member 500 may slide along the transverse axis 70 through the opening 412. Another inner shield member 500 may be inserted into the channel 410 through the opening 412 and locked into position, as described above.

INDUSTRIAL APPLICABILITY

The present disclosure provides an advantageous system and apparatus for protecting components of an impact hammer system 200. During a breaking operation, broken pieces of hardened material, such as rocks, concrete, or the like, may strike the impact hammer 200. The outer shield member 400 and the inner shield member 500 may deflect or otherwise block the hardened material from contacting a lower portion of the tool 200.

An easily replaceable component, such as the inner shield member 500, decreases down time while still allowing for increased protection of the lower housing 202. During operation, as the inner shield member 500 becomes increasingly worn, the work tool 110 may be removed from the housing and the inner shield member 500 may slide out of the channel 410 through the opening 412. A new inner shield member 500 may replace the expired shield member 500 and be locked into place by the work tool 110.

The inner shield member 500 may include a minimal number of components simplifying the manufacturing process, therefore, allowing multiple replications of the inner shield member 500 to be produced. The inner shield member 500 may be constructed using a material that has high strength and that is commonly used in the art further simplifying the manufacturing process and providing effective protection of the lower components of the hammer 200.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A protection assembly for an impact hammer system that includes a housing and a work tool projecting out of the housing, the protection assembly comprising:

a first outer shield member spaced apart from the housing by a first distance along a longitudinal direction, the housing and the first outer shield member defining a channel therebetween, the channel extending in a transverse direction that is perpendicular to the longitudinal direction, such that the channel extends along the transverse direction and through the protection assembly to define a transverse opening, the first outer shield member having an outer concave edge that extends in a circumferential direction about a first axis that extends along the longitudinal direction; and an inner shield member having an internal edge and an external edge, the internal edge extending in the circumferential direction about a second axis that extends along the longitudinal direction, the internal edge defining an internal opening through the inner shield member, and the internal edge of the inner shield member being disposed closer to the first axis than the outer concave edge of the first outer shield member along a radial direction, the radial direction being perpendicular to the longitudinal direction; wherein:

in a pre-assembly configuration of the protection assembly, the inner shield member is configured to enter the channel through the transverse opening and slide along the channel in the transverse direction; and in an assembled configuration of the protection assembly, the inner shield member is configured to be restricted in the longitudinal direction by the first outer shield member and in the transverse direction by the work tool inserted through the internal opening.

2. The protection assembly of claim 1, wherein the inner shield member has a rectangular shape.

3. The protection assembly of claim 1, wherein the inner shield member is a flat plate.

4. The protection assembly of claim 3, wherein the inner shield member has a thickness dimension that extends in the longitudinal direction, and wherein the thickness dimension of the inner shield member is the same as the first distance.

5. The protection assembly of claim 1, wherein the internal opening is positioned at a geometric center of the inner shield member.

6. The protection assembly of claim 1, wherein the first axis and the second axis are coaxial.

7. The protection assembly of claim 1, further comprising a second outer shield member spaced apart from the housing by the first distance along the longitudinal direction, wherein the housing, the first outer shield member, and the second outer shield member define the channel therebetween.

8. The protection assembly of claim 1, wherein the outer concave edge of the first outer shield member is disposed closer to the first axis than the external edge of the inner shield member along the radial direction.

9. The protection assembly of claim 1, wherein the channel extends to multiple exterior surfaces of the protection assembly.

10. The protection assembly of claim 1, wherein the first outer shield member is coupled to the housing.

11. The protection assembly of claim 1, wherein the impact hammer system is a hydraulic hammer system.

12. The protection assembly of claim 1, wherein a shape and size of the internal opening is similar to a shape and size of a cross section of an outer surface of the work tool to allow a slip fit tolerance therebetween.

13. The protection assembly of claim 1, further comprising a bushing positioned within the housing, the bushing having an inner guide surface sized to slideably receive the work tool.

14. The protection assembly of claim 1, further comprising an interior seal extending circumferentially about the first axis, the interior seal having a sealing ring that extends radially inward so as to sealingly engage the work tool.

15. The protection assembly of claim 14, wherein the interior seal is constructed of a material that is more flexible than a material of the inner shield member.

* * * * *